United States Patent [19]

Sakuranaka et al.

[11] Patent Number: 4,664,079

[45] Date of Patent: May 12, 1987

[54] FUEL INJECTION SYSTEM FOR INTERNAL COMBUSTION ENGINES

[75] Inventors: Toru Sakuranaka; Yutaka Tajima; Hisashi Nakamura, all of Higashimatsuyama, Japan

[73] Assignee: Diesel Kiki Co., Ltd., Tokyo, Japan

[21] Appl. No.: 905,068

[22] Filed: Sep. 8, 1986

[30] Foreign Application Priority Data

Sep. 12, 1985 [JP] Japan ..... 60-138765[U]
Jan. 22, 1986 [JP] Japan ..... 61-6625[U]

[51] Int. Cl.[4] ..... F02M 39/00

[52] U.S. Cl. ..... 123/370; 123/449; 123/374; 123/373

[58] Field of Search ..... 123/373, 365, 364, 370, 123/342, 374, 449

[56] References Cited

U.S. PATENT DOCUMENTS

| | | | |
|---|---|---|---|
| 2,571,571 | 10/1951 | Hanners | 123/370 |
| 4,328,797 | 5/1982 | Yasuhara | 123/370 |
| 4,368,706 | 1/1983 | Yasuhara | 123/370 |
| 4,397,280 | 8/1983 | Yasuhara | 123/370 |
| 4,449,504 | 5/1984 | Furuhashi | 123/449 |
| 4,498,437 | 2/1985 | Ohkoshi | 123/374 |
| 4,567,870 | 2/1986 | Tomber | 123/370 |
| 4,615,317 | 10/1986 | Bofinger | 123/373 |

FOREIGN PATENT DOCUMENTS

| | | | |
|---|---|---|---|
| 3125124 | 1/1983 | Fed. Rep. of Germany | 123/370 |
| 3122666 | 1/1983 | Fed. Rep. of Germany | 123/370 |
| 0012049 | 1/1979 | Japan | 123/370 |
| 57-30338 | 2/1982 | Japan | 123/370 |
| 0048718 | 3/1983 | Japan | 123/370 |
| 0107820 | 6/1983 | Japan | 123/370 |
| 60-53627 | 3/1985 | Japan | 123/370 |
| 475477 | 11/1937 | United Kingdom | 123/370 |

*Primary Examiner*—Carl Stuart Miller
*Attorney, Agent, or Firm*—Frishauf, Holtz, Goodman & Woodward

[57] ABSTRACT

In a fuel injection system for an internal combustion engine, a control lever shaft interlocked with a governor spring is supported by a pump housing of a fuel injection pump with one and the other ends respectively located interiorly and exteriorly of the pump housing. A control lever for controlling the fuel injection amount is fixedly mounted on the other end of the control lever shaft. A cancel lever connected to an accelerator pedal through an accelerator rod is freely fitted on the other end of the control lever shaft. The control lever and the cancel lever are disposed to abut against each other on a leading side of the cancel lever with reference to the angular movement thereof in a fuel decreasing direction. A cancel spring is connected between the control lever and the cancel lever to allow them to be angularly moved together. A dash pot for restricting the speed of movement of the control lever in a fuel increasing direction is arranged exteriorly of the pump housing. A synthetic resin bush may be interposed between the cancel lever and the control lever shaft.

7 Claims, 5 Drawing Figures

FUEL INJECTION SYSTEM FOR INTERNAL COMBUSTION ENGINES

BACKGROUND OF THE INVENTION

The present invention relates to a fuel injection system for internal combustion engines and, more particularly, to an engine rapid acceleration restricting device provided in such a fuel injection system.

A fuel injection system of the kind referred to above, for example, a fuel injection system including a fuel injection pump provided therein with a governor of all speed type, is generally arranged such that, when the rotational speed of the engine reaches a value set by depressing operation of the accelerator pedal, the amount of fuel to be injected into the engine is regulated under the action of the governor so as to control the rotational speed of the engine to the set value. Because of such arrangement, however, as the accelerator pedal is rapidly depressed, the regulating action of the governor does not effectively function for a short period of time immediately after the rapid depression of the accelerator pedal. This results in a rapid increase in the amount of fuel fed into the engine and in a rapid increase in the rotational speed of the engine. However, the speed of a vehicle having the engine mounted thereon cannot follow such rapid increase in the rotational speed of the engine. This raises such problems that jerky or wobbly vibration occurs on the vehicle, causing uncomfortable driving feeling, as well as such a problem that the amount of fuel into the engine is made excessive to cause incomplete combustion. In order to avoid such problems, Japanese Provisional Utility Model Pubulication (Kokai) No. 57-30338 and Japanese Provisional Patent Publication (Kokai) No. 60-53627 have proposed to employ a dash pot which is associated with a tension lever for controlling the action of the govenor so as to restrict and retard the moving speed of the tension lever with respect to the speed of the depressing operation of the accelerator pedal.

In the above-mentioned prior art, however, the dash pot is located in a narrow space within a pump housing of the fuel injection pump, making it difficult to provide a sufficient operating stroke for the dash pot and thus preventing the dash pot from exhibiting a sufficient damping function. Further, as the temperature of the fuel within the pump housing rises during operation of the engine, the damping effect of the dash pot is considerably reduced.

Additionally, in the above-mentioned prior art, it is so arranged that when the accelerator pedal is depressed, a reaction force produced by the damping action of the dash pot is directly transmitted to the accelerator pedal. This causes the operator to feel an unpleasant resistance, and makes the depressing feeling uncomfortable.

OBJECTS AND SUMMARY OF THE INVENTION

It is an object of the invention to provide a fuel injection system equipped with an acceleration-restricting dash pot for an internal combustion engine, which can prevent the amount of fuel injected into the engine from being rapidly increased when the accelerator pedal is rapidly depressed, which can reduce the resistance that the operator feels when depressing the accelerator pedal to improve the depressing feeling, and which has the dash pot mounted at a location where a sufficient damping effect is ensured.

It is another object of the invention to provide a fuel injection system equipped with an acceleration-restricting dash pot for an internal combustion engine, which can prevent some component from being damaged due to the depression of the accelerator pedal.

According to the present invention, there is provided a fuel injection system for an internal combustion engine, comprising:

a fuel injection pump including a pump housing having a wall and filled with fuel, pumping means for forcibly delivering the fuel within the pump housing to the engine, and control means associated with the pumping means for controlling an amount of fuel delivered by the pumping means to the engine;

an accelerator pedal disposed to be depressed;

a governor arranged within the pump housing and associated with the control means for regulating the amount of fuel delivered by the pumping means to the engine, in dependence on the rotational speed of the engine;

a control lever shaft supported by the wall of the pump housing for angular movement about an axis thereof relative thereto, the control lever shaft extending through the wall of the pump housing and having one end located interiorly of the pump housing and another end located exteriorly thereof;

governor spring means connected between the one end of the control lever shaft and the control means for transmitting the angular movement of the control lever shaft to the control means in a manner such that when the control lever shaft angularly moves in a first direction the control means decreases the amount of fuel delivered by the pumping means to the engine, and when the control lever shaft angularly moves in a second direction the control means increases the amount of fuel delivered by the pumping means to the engine at a rate corresponding to the speed of the angular movement of the control lever shaft;

a control lever fixedly mounted on the another end of the control lever shaft for angular movement therewith in the first and second directions;

a cancel lever freely fitted on the another end of the control lever shaft for angular movement relative thereto, the cancel lever being disposed to abut against the control lever on a leading side of the cancel lever with reference to the angular movement thereof in the first direction;

cancel spring means connected between the control lever and the cancel lever and acting upon them to be angularly moved together;

an accelerator rod connecting the accelerator pedal to the cancel lever for transmitting depressing movement of the accelerator pedal to the cancel lever to angularly move the cancel lever in the first and second directions; and a dash pot arranged exteriorly of the pump housing and associated with the control lever for applying a counteracting force to the angular movement of the control lever in the second direction against the force of the cancel spring means.

The force of the cancel spring means is set such that when the accelerator pedal is depressed to angularly move the cancel lever at a speed lower a predetermined value, the cancel spring means is not substantially resiliently deformed by the counteracting force of the dash pot to allow the cancel lever and the control lever to be angularly moved together in the second direction, while when the accelerator pedal is depressed to angularly move the cancel lever at a speed higher than the predetermined value, the cancel spring means is resiliently deformed by the counteracting force of the dash pot to allow the control lever to be angularly moved in the second direction behind the angular movement of the cancel lever in the second direction to thereby reduce the rate of increase of the amount of fuel delivered by the pumping means to the engine through the control means.

Preferably, the fuel injection system includes a bush which is formed of a synthetic resin and interposed between the cancel lever and the control lever shaft, and through which the cancel lever is freely fitted on the control lever shaft.

The above and other objects, features and advantages of the invention will be more apparent from the ensuing detailed description taken in conjunction with the accompanying drawings.

DETAILED DESCRIPTION

An embodiment of a fuel injection system for an internal combustion engine according to the invention will now be described with reference to the drawings.

Figure 1:
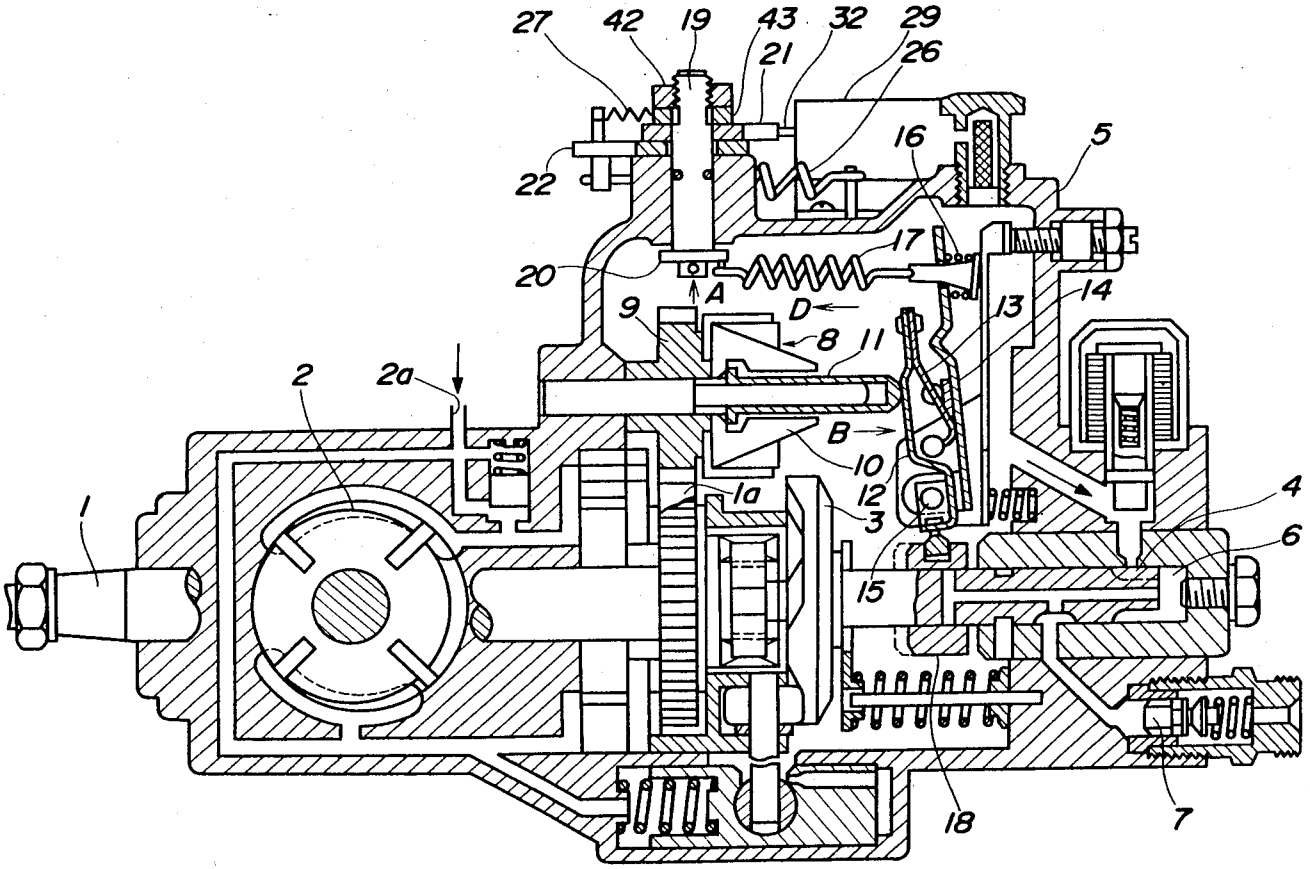
FIG. 1 is a schematic longitudinal cross-sectional view showing a fuel injection pump incorporated in a fuel injection system with a feed pump shown in transverse cross-section according to an embodiment of the invention.

Referring to FIG. 1, there is shown a distributor type fuel injection pump which is incorporated in the fuel injection system. The fuel injection pump comprises a drive shaft 1 connected to an output shaft (not shown) of the engine to be rotatively driven thereby. The drive shaft 1 in turn drives a feed pump 2 shown in a manner angularly developed through 90 degrees from the other parts of the pump, and also rotatively drives a cam disc 3. Rotation of the cam disc 3 causes a plunger 4 to be rotated while being reciprocated. Fuel is supplied from a fuel tank (not shown) into a pump housing 5 through the feed pump 2. Fuel supplied into the pump housing 5 is drawn into a pressurizing chamber.6 and is pressurized by the plunger 4. The pressurized fuel is forcibly delivered to a fuel injection nozzle (not shown) through a passageway formed in the plunger 4 and through a delivery valve 7, and is injected into a combustion chamber of the engine through the fuel injection nozzle.

A governor 8 is arranged within the pump housing 5 and comprises a pair of flyweights 10, and a gear 9 in mesh with a gear 1*a* mounted on the drive shaft 1 for rotation therewith to cause rotation of the flyweights 10. As the rotational speed of the drive shaft 1 increases to increase the rotational speed of the gear 9, the flyweights 10 of the governor 8 are radially outwardly moved to move a governor sleeve 11 in a direction indicated by the arrow B in FIG. 1. The movement of the governor sleeve 11 is transmitted to a tension lever 14 through a starting lever 12 and a starting spring 13, to angularly move the tension lever 14 about a pivot 15 in the clockwise direction as viewed in FIG. 1. The clockwise movement of the tension lever 14 causes an idling spring 16 to be compressed to tension a governor spring 17 engaged at one end with the spring 16 and to move a control sleeve 18 slidably fitted on the plunger 4 to the left in FIG. 1, to thereby reduce the amount of fuel forcibly delivered by the fuel injection pump to the engine.

As the governor spring 17 is pulled in a direction indicated by the arrow D as will be described later, the tension lever 14 is angularly moved about the pivot 15 in the counterclockwise direction to move the control sleeve 18 to the right, to thereby increase the amount of fuel forcibly delivered by the fuel injection pump to the engine.

Figure 2:
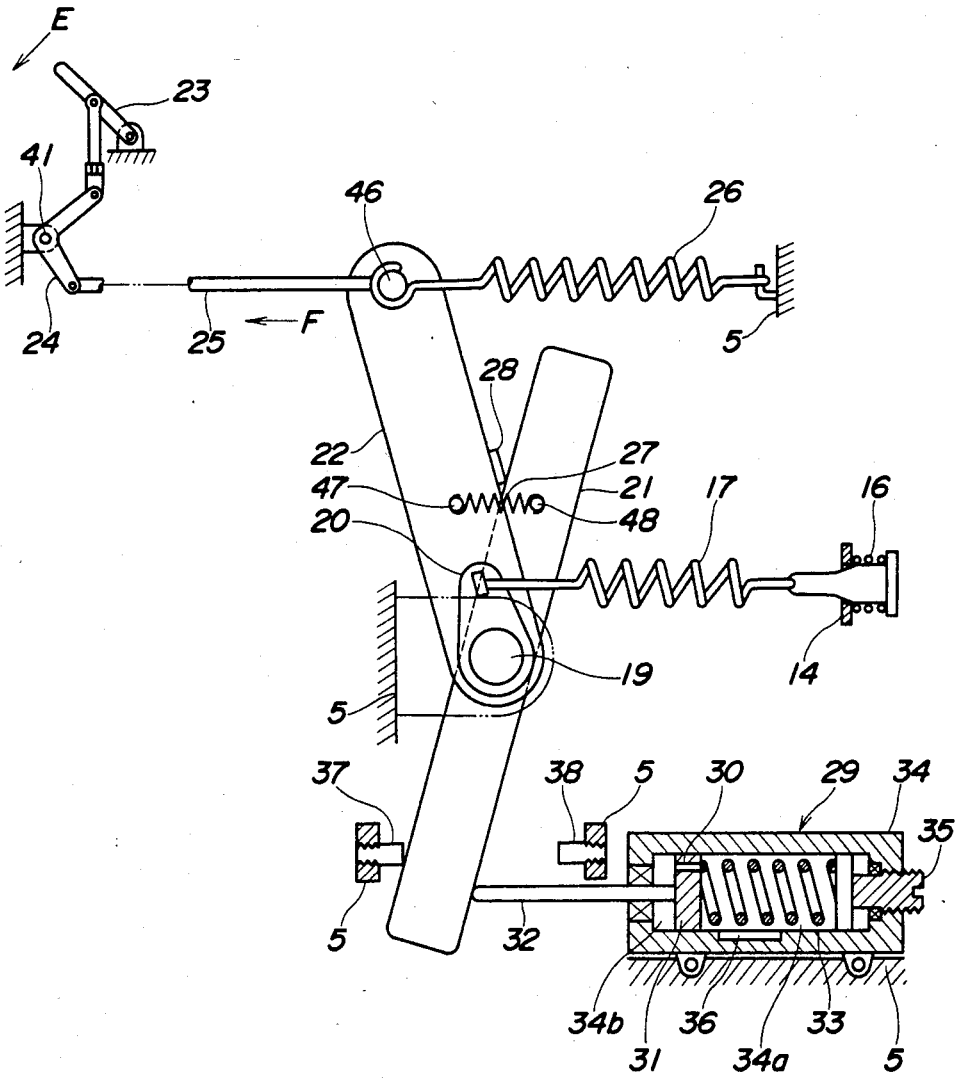
FIG. 2 is a fragmental schematic view as viewed from the arrow A in FIG. 1, with levers, spring, dash pot and the like located exteriorly of a pump housing being indicated in solid lines for convenience, such components being practically invisible from the location of the arrow A.
Figure 3:
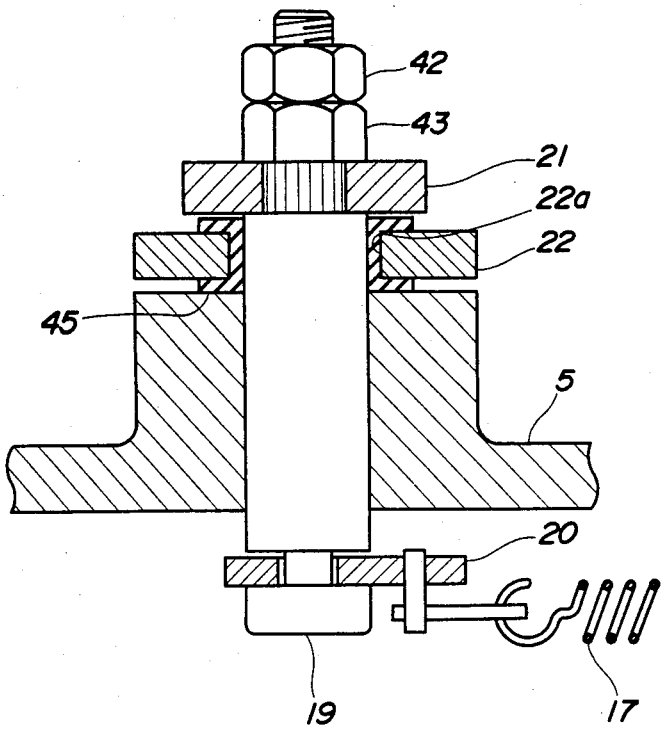
FIG. 3 is a fragmental cross-sectional view showing, on an enlarged scale, a control lever shaft an components associated therewith shown in FIGS. 1 and 2.

As clearly shown in FIG. 3, a control lever shaft 19 is supported by a ceiling wall of the pump housing 5 for angular movement about its own axis relative thereto, and is fitted liquid-tightly through the ceiling wall of the pump housing 5 with its one end located interiorly of the pump housing 5 and the other end located exteriorly thereof. A lever 20 has one end thereof rigidly fitted on the one end of the control lever shaft 19 for rotation therewith. As shown in FIG. 2, the governor spring 17 has the other end engaged with the other free end of the lever 20. An elongated control lever 21 is arranged exteriorly of the pump housing 5 and has a longitudinally intermediate portion rigidly fitted on the other end of the control lever shaft 19. Further, the control lever 21 is fixedly secured to the control lever shaft 19 by means of lock nuts 42 and 43 screwed on a threaded tip of the shaft 19. The control lever 21 thus mounted on the control lever shaft 19 is angularly movable therewith about the axis of the latter. An idle stopper 37 and a full load stopper 38 are threadedly fitted in the wall of the pump housing 5 to limit the maximum angular moving stroke of the control lever 21. A cancel lever 22 has one end thereof freely fitted on the control lever shaft 19 through a bush 45 formed of a synthetic resin shown in FIG. 4, for angular movement relative to the control lever shaft 19. An acclerator pedal 23 is connected to the other free end of the cancel lever 22 through an angled lever 24 angularly mavable about a pivot 41 and through an accelerator rod 25. A return spring 26 has one end thereof engaged with the pump housing 5 and the other end engaged with a pin 46 on the other free end of the cancel lever 22, for biasing same in a fuel decreasing directi.on in which the amount of fuel delivered by the fuel injection pump to the engine decreases, i.e., in the clockwise direction as viewed in FIG. 2. The control lever 21 and the cancel lever 22 are disposed to abut against each other on a leading side of the lever 22, via a stopper 28, with reference to the angular movement thereof in the fuel decreasing direction, i.e., in the clockwise direction in FIG. 2. A cancel spring 27 comprised of a coil spring is connected between a longitudinally intermediate portion of the cancel lever 22 and an end portion of the one end of the control lever 21 and pulling the levers 22 and 21 toward each other so as to be angularly moved together. More specifically, the cancel spring 27 has one end thereof engaged with a pin 47 on the cancel lever 22 and the other end engaged with a pin 48 on the one end of the control lever 21. The stopper 28 is secured to the cancel lever 22 for abutting against the control lever 21, to thereby determine the relative position of the control lever 21 to the cancel lever 22. A dash pot 29 is arranged exteriorly of the pump housing 5, e.g. it is mounted on an outer surface of the ceiling wall of the pump housing 5 for restricting the speed of angular movement of the control lever 21 in the fuel increasing direction, i.e., in the counterclockwise direction in FIG. 2. The cancel spring 27 has its force or setting load set such that when the accelerator pedal 23, i.e. cancel lever 22 is angularly moved in the fuel increasing direction at a speed lower than a predetermined value, the dash pot 29 does not substantially apply its damping action to the control lever 21 to allow smooth angular movement of the control lever so that the cancel spring 27 is not substantially resiliently deformed by the control lever i.e. by the dash pot 29, causing the control lever 21 and the cancel lever 22 to be angularly moved together, while, when the cancel lever 22 is angularly moved in the fuel increasing direction at a speed higher than the predetermined value, the dash pot 29 applies the damping action to the control lever 21 to retard the angular movement of the control lever 21 so that the cancel spring 27 is resiliently deformed by the control lever 21 or the dash pot 29, causing the control lever 21 to be angularly moved behind the angular movement of the cancel lever 22.

The dash pot 29 in the embodiment illustrated in FIG. 2 comprises a cylinder 34 filled with an operating oil, a piston 31 having an orifice 30 formed therein and slidably received within the cylinder 34 to define therein a right chamber **34*a* and a left chamber 34*b* communicated with each other through the orifice 30, a piston rod 32 secured to the piston 31 and extending exteriorly of the cylinder 34 through an end wall thereof, a spring 33 accommodated within the cyulinder 34 for biasing the piston 31 in such a direction as to project the piston rod 32 from the end wall of the cylinder 34, and an adjusting screw 35 for adjusting the biasing force of the spring 33. The piston rod 32 is biased by the spring 33 so that a free end of the piston 32 always abuts against the other end of the control lever 21. To ensure that the dash pot 29 exhibits its damping function in the above stated manner, the biasing force of the spring 33 is set at a value slightly lower than the biasing force or setting load of the cancel spring 27. A groove 36 is formed in the inner peripheral surface of the cylinder 34 and extends along the axis thereof to reduce the damping action of the piston 31**, when the engine operates in a region ranging between an idling region and an intermediated point of a full load, high speed operating region.

Figure 4:
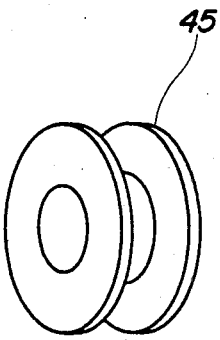
FIG. 4 is a perspective view showing a bush of a synthetic resin shown in FIG. 3.

The aforesaid synthetic resin bush 45, shown in FIG. 4, interposed between the cancel lever 22 and the control lever shaft 19 prevents shakiness of the cancel lever 22 on the control lever 21. The bush 45 is preferably formed of polyacetal or polyoxymethylene resin, which have high lubricity, a nylon resin having high wear-resistance and low coefficient of friction, or the like resin. The bush 45 reduces the friction between the cancel lever 22 and the control lever shaft 19, the friction between the cancel lever 22 and the opposed surface of the pump housing 5, and the friction between the cancel lever 22 and the lower surface of the control lever 21, to thereby make the movement of such components smooth. The bush 45 also prevents the concel lever 22 from sticking to the control lever shaft 19, to thereby ensure smooth angular movement of the cancel lever 22. The illustrated bush 45 is of one piece type in which, in manufacture, the bush is insert-molded in a bore **22*a* which is formed in the cancel lever 22 and through which the cancel lever 22 is freely fitted on the control lever shaft 19, by means of an injection molding machine. Thus the bush is fabricated in one body with the cancel lever 22, and thereafter assembled with the control lever shaft 19**.

Figure 5:
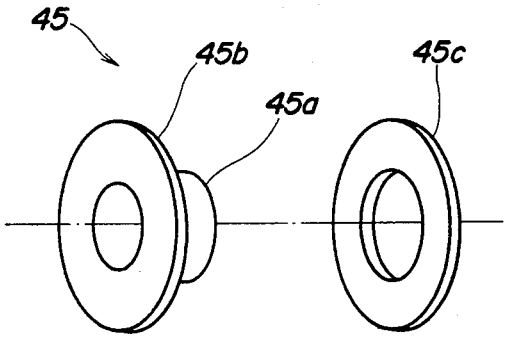
FIG. 5 is an exploded perspective view showing a modification of the bush shown in FIG. 3.

The bush 45 may be of a two piece type, as shown in FIG. 5, which comprises a cylindrical body **45*a* having one axial end thereof formed integrally with an annular radial flange 45*b*, and an annular flange member 45*c* separate from the body 45*a* and adapted to be mounted, in use, on the other axial end thereof as another annular radial flange. The body 45*a* formed with the flange 45*b* is inserted into the bore 22*a* formed in the cancel lever 22 and a central bore in the annular flange member 45*c* when the bush 45 is assembled with the control lever shaft 19**.

The operation of the fuel injection system constructed as above will now be described. As the accelerator pedal 23 is depressed in the direction indicated by the arrow E in FIG. 2, the lever 24 is angularly moved about the pivot 41 in the clockwise direction in FIG. 2, and the accelerator rod 25 is moved in the fuel increasing direction indicated by the arrow F, to angularly move the cancel lever 22 in the counterclockwise direction. The counterclockwise movement of the cancel lever 22 is transmitted to the control lever 21 through the concel spring 27 to angularly move the control lever 21 in the counterclockwise direction. The counterclockwise movement of the control lever 21 in turn causes the control lever shaft 19 and the lever 20 to be angularly moved together in the counterclockwise direction, to pull the governor spring 17 in the direction indicated by the arrow D in FIG. 1, to thereby increase the amount of fuel delivered from the fuel injection pump to the engine as described previously. When the accelerator pedal 23 is depressed at a normal or relatively low speed below the aforementioned predetermined speed, the speed of the angular movement of the control lever 21 in the counterclockwise direction and accordingly the speed of the rightward movement of the piston 31 are relatively low. Consequently, the operating oil within the right chamber **34*a* of the cylinder 34 flows into the left chamber 34*b* through the orifice 30 substantially without flow resistance so that the dash pot 29 does not substantially apply its damping action to the control lever 21, that is, the force acted upon the control lever 21 by the dash pot 29 is relatively low. Hence the cancel spring 27 is not substantially resiliently deformed to allow the cancel lever 22 and the control lever 21 to be angularly moved substantially in unison in the counterclockwise direction. As a result, the fuel control is performed without operation delay, to supply the engine with an amount of fuel proportionate to the depressing amount of the accelerator pedal 23**.

When the accelerator pedal 23 is rapidly depressed, the control lever 21 is about to be angularly moved rapidly in the counterclockwise direction and the piston 31 is about to be moved rapidly to the right, during a short period of time immediately after the depression of the accelerator pedal 23. Consequently, the orifice 30 effectively functions to restrict the flow of operating oil therethrough, to cause the dash pot 29 to sufficiently exhibit the damping action, so that the speed of the counterclockwise movement of the control lever 21 is sufficiently restrained. Thus, the counterclockwise movement of the control lever 21 is retarded with respect to the rapid counterclockwise movement of the cancel lever 22. This results in a gentle counterclockwise movement of the control lever shaft 19 and the lever 20, and consequently in a gentle increase in the tension force of the governor spring 17, so that a rapid increase in the amount of fuel delivered to the engine is avoided. Furthermore, the cancel spring 27 is resiliently deformed or stretched. By the restitution force of the stretched cancel spring 27, the other end of the control lever 21 and the piston 31 continue to subsequently be moved gently, respectively, in the counterclockwise direction and to the right, even after the accelerator pedal 23 has been depressed to a certain position and held thereat. In a short time, the control lever 21 and the piston 31 reach their respective positions determined or set by the depressed position of the accelerator pedal 23. Thus, the amount of fuel fed to the engine is increased exactly to the value set by the accelerator pedal 23.

As described above, when the accelerator pedal 23 is rapidly depressed, only the cancel lever 22 is angularly moved precedently of the control lever 21, so that the cancel spring 27 is resiliently deformed or stretched, and the governor spring 17 is actuated at a speed retarded by the dash pot 29, thus making it possible to prevent the vehicle from being rapidly accelerated, and to prevent incomplete combustion from occurring due to an excessive supply of the fuel to the engine. Moreover, since only the cancel lever 22 is precedently moved together with the accelerator pedal 23, an abnormal feeling of resistance upon depression of the accelerator pedal 23 can be eliminated, to improve the depressing operation feeling.

Although the cancel lever 22 is freely fitted on the control lever shaft 19, the interposition of the synthetic resin bush 45 therebetween eliminates the shakiness of the cancel lever 22 on the shaft 19 and also reduces the frictional resistance therebetween. Consequently, the cancel lever 22 is angularly moved smoothly without difficulty, to thereby prevent the cancel lever 22 from being skewed with respect to the control lever shaft 19. Thus, it is possible to positively maintain the performance of the dash pot 29 for a long period of time and also to prevent the components from being damaged even if the accelerator pedal is forcibly depressed. Furthermore, even if the synthetic resin bush 45 is interposed between the cancel lever 22 and the control lever shaft 19, the heights of the cancel lever 22 and control lever 21 with respect to the ceiling wall surface of the pump housing 5 is maintained substantially unchanged. Thus, it is possible to use the control lever shaft of a standard type. This is advantageous in respect of manufacturing cost.

Although in the illustrated embodiment of the invention the cancel spring 27 is of a tension type, it may be a torque spring or of a compression type. Further, the dash pot 29 is not limited to the illustrated example.

Moreover, since the dash pot 29, control lever 21, cancel lever 22 and the like are mounted exteriorly of the pump housing 5, it is possible to use as such dash pot 29 and other components those which have sufficiently large sizes or dimensions and superior functions, and it is also possible to carry out maintenance and adjustment of these components with ease.

What is claimed is:

1. A fuel injection system for an internal combustion engine, comprising:

a fuel injection pump including a pump housing having a wall and filled with fuel, pumping means for forcibly delivering the fuel within said pump housing to the engine, and control means associated with said pumping means for controlling an amount of fuel delivered by said pumping means to the engine;

an accelerator pedal disposed to be depressed;

a governor arranged within said pump housing and associated with said control means for regulating the amount of fuel delivered by said pumping means to the engine, in dependence on the rotational speed of the engine;

a control lever shaft supported by said wall of said pump housing for angular movement about an axis thereof relative thereto, said control lever shaft extending through said wall of said pump housing and having one end located interiorly of said pump housing and another end located exteriorly thereof;

governor spring means connected between said one end of said control lever shaft and said control means for transmitting the angular movement of said control lever shaft to said control means in a manner such that when said control lever shaft angularly moves in a first direction said control means decreases the amount of fuel delivered by said pumping means to the engine, and when said control lever shaft angularly moves in a second direction said control means increases the amount of fuel delivered by said pumping means to the engine at a rate corresponding to the speed of the angular movement of said control lever shaft;

a control lever fixedly mounted on said another end of said control lever shaft for angular movement therewith in said first and second directions;

a cancel lever freely fitted on said another end of said control lever shaft for angular movement relative thereto, said cancel lever being disposed to abut against said control lever on a leading side of said cancel lever with reference to the angular movement thereof in said first direction;

cancel spring means connected between said control lever and said cancel lever and acting upon them to be angularly moved together;

an accelerator rod connecting said accelerator pedal to said cancel lever for transmitting depressing movement of said accelerator pedal to said cancel lever to angularly move said cancel lever in said first and second directions; and a dash pot arranged exteriorly of said pump housing and associated with said control lever for applying a counteracting force to the angular movement of said control lever in said second direction against the force of said cancel spring means;

the force of said cancel spring means being set such that when said accelerator pedal is depressed to angularly move said cancel lever at a speed lower a predetermined value, said cancel spring means is not substantially resiliently deformed by said counteracting force of said dash pot to allow said cancel lever and said control lever to be angularly moved together in said second direction, while when said accelerator pedal is depressed to angularly move said cancel lever at a speed higher than said predetermined value, said cancel spring means is resiliently deformed by said counteracting force of said dash pot to allow said control lever to be angularly moved in said second direction behind the angular movement of said cancel lever in said second direction to thereby reduce the rate of increase of the amount of fuel delivered by said pumping means to the engine through said control means.

2. A fuel injection system as defined in claim 1, wherein said control lever has an elongated body having one end, another end, and a longitudinally intermediate portion, said control lever having said longitudinally intermediate portion thereof fixedly mounted on said control lever shaft, said cancel spring means being connected between said cancel lever and said one end of said control lever, said dash pot being disposed to act on said another end of said control lever.

3. A fuel injection system as defined in claim 2, wherein said cancel spring means comprises a tension spring having one end and another end thereof engaged respectively with said cancel lever and said one end of said control lever.

4. A fuel injection system as defined in claim 1, including:

a bush formed of a systhetic resin and interposed between said cancel lever and said control lever shaft;

said cancel lever being freely fitted on said control lever shaft through said bush for angular movement relative to said control lever shaft.

5. A fuel injection system as defined in claim 4, wherein said bush is of one piece type in which said bush is insert-molded in a bore which is formed in said cancel lever and through which said cancel lever is freely fitted on said control lever shaft.

6. A fuel injection system as defined in claim 4, wherein said bush is of two piece type comprising a cylindrical body having one exial end thereof formed integrally with a flange, and another axial end, and a flange member separate from said cylindrical body and adapted to be mounted, in use, on said another axial end of said cylindrical body.

7. A fuel injection system as defined in claim 4, wherein said bush is formed of a synthetic resin selected from the group consisting of polyacetal resin, polyoxymethylene resin, and nylon resin.

* * * * *